United States Patent [19]

van der Eikel

[11] Patent Number: 4,747,716

[45] Date of Patent: May 31, 1988

[54] RIBBON CASSETTE

[75] Inventor: Jan van der Eikel, Adelsdorf, Fed. Rep. of Germany

[73] Assignee: Ta Triumph-Adler Aktiengesellschaft, Nuremberg, Fed. Rep. of Germany

[21] Appl. No.: 2,745

[22] Filed: Jan. 12, 1987

[51] Int. Cl.[4] ..... B41J 35/36

[52] U.S. Cl. ..... 400/249; 400/208; 400/234

[58] Field of Search ..... 400/249, 282, 239, 208; 250/570

[56] References Cited

U.S. PATENT DOCUMENTS

| | | | |
|---|---|---|---|
| 3,234,392 | 2/1966 | Dickinson | 250/570 |
| 3,458,706 | 7/1969 | Ravanhall et al. | 250/570 |
| 3,956,681 | 5/1976 | Vail et al. | 250/570 |
| 4,111,378 | 9/1978 | Barwick | 400/249 |
| 4,205,923 | 6/1980 | Sasaki et al. | 400/234 |
| 4,268,992 | 1/1983 | Gagnebin | 400/234 |
| 4,475,829 | 10/1984 | Goff, Jr. et al. | 400/232 |
| 4,533,266 | 8/1985 | Saito et al. | 400/234 |

FOREIGN PATENT DOCUMENTS

| | | | |
|---|---|---|---|
| 0121971 | 10/1984 | European Pat. Off. . | |
| 2553329 | 5/1976 | Fed. Rep. of Germany . | |
| 2742974 | 3/1979 | Fed. Rep. of Germany | 400/249 |
| 3109299 | 7/1981 | Fed. Rep. of Germany . | |
| 3214548 | 11/1983 | Fed. Rep. of Germany . | |
| 57-47686 | 3/1982 | Japan . | |
| 58-59096 | 4/1983 | Japan . | |
| 78879 | 5/1984 | Japan | 400/249 |
| 165281 | 8/1985 | Japan | 400/249 |
| 168688 | 9/1985 | Japan | 400/249 |

OTHER PUBLICATIONS

Yarrington Film Supply Indicator, IBM Technical Disclosure Bulletin, vol. 25, No. 1, pp. 273–274.

*Primary Examiner*—William Pieprz
*Attorney, Agent, or Firm*—Browdy and Neimark

[57] ABSTRACT

A ribbon cassette is provided with a rotatably mounted ribbon supply spool whose flange has markings, angularly spaced according to ribbon type, which are adapted to be successively sensed as ribbon is incrementally drawn off a supply spool to provide signals from which the type of ribbon in the cassette can be identified and the feed increments therefore determined, and information regarding the supply of ribbon remaining on the spool, end of ribbon and ribbon jams may be derived in a programmed control unit. The ribbon cassette further comprises a two-armed lever pivotally mounted in the cassette housing, having first and second lever arms which engage teeth on the edge of the spool flange when the two-armed lever is in a first end condition and a second end condition respectively.

7 Claims, 2 Drawing Sheets

RIBBON CASSETTE

This invention relates to a ribbon cassette for electronic typewriters or similar business machines having programmed control units; more particularly it relates to a ribbon cassette containing a rotatably mounted supply spool whose flange has markings which can be sensed incident to feed movement of the supply spool and used in the programmed control unit to identify the type of ribbon in the cassette to control feed increments and to determine the amount of ribbon remaining, end of ribbon and ribbon malfunctions.

In such machines, ribbon cassettes with different ribbons such as carbon C ribbons, multi-carbon ribbons, fabric ribbons, ribbons of different color, etc. are used to carry out different tasks. In order to ensure optimum utilization of the ribbon type selected and mounted a certain length of the ribbon must be advanced before each impression of a character. For this reason, it is necessary to adjust the programmable control unit usually present in such equipment and which controls the ribbon advance for the type of ribbon selected. Also, it is desirable, particularly when switching the machine on, to provide an operator with an indication of the type of ribbon mounted in the machine.

Furthermore, in so-called memory-type typewriters or in output printers for data processing equipment - since unsupervised operation is possible with such equipment - it is necessary that the equipment should be switched off automatically on reaching tne end of the ribbon or in the event of ribbon feed malfunctions. Apart from this automatic ribbon monitoring, an indication of the supply of ribbon remaining in a ribbon cassette is helpful, so that an operator can estimate, before the start of a printing task, whether the ribbon still available is sufficient to carry out the printing task.

To accomplish the above noted desiderata requires that the ribbon cassette, in association with a sensor and a programmed control unit, have a ribbon supply spool whose flange has markings, angularly spaced according to ribbon type, which can be successively sensed as ribbon is increemetally driven off said supply spool, and from which, depending on the number of feed increments issued by a programmed control unit between markings, the type of ribbon can be identified, the feed increments therefore determined, and other information relating to amount of ribbon remaining, ribbon malfunctions or end of ribbon may be derived in the programmed control unit.

It is therefore an object of the present invention to develop a ribbon cassette from which the information necessary to derive a plurality of different items of information can simply, and cheaply, be obtained.

Another object of the invention is in the provision of markings on a supply spool flange supported in a ribbon cassette which are capable of being sensed by a sensor as ribbon is drawn off during printing to provide signals to a programmed control unit wherein ribbon type, end of the ribbon, amount of ribbon remaining in the ribbon supply spool and ribbon feed malfunctions may be determined.

Another object of the invention is in the provision of means in the ribbon cassette to prevent said spool from rotating when the end of the ribbon is reached or a ribbon feed malfunction occurs.

Still another of the object of the invention is in the provision of a ribbon supply spool flange having markings which are angularly spaced according to ribbon type, and sensible by optical, mechanical or inductive scanning.

A still further object of the invention is in the provision of a ribbon supply spool flange having angularly spaced sensible markings disposed over a circular path around the flange each marking comprising a code identifying ribbon type.

Other objects, features and advantages of the present invention will become better known to those skilled in the area from a reading of the following detailed description when taken in conjunction with the accompanying drawing wherein like reference numerals designate like or corresponding elements throughout the several views thereof and wherein.

Figure 1:
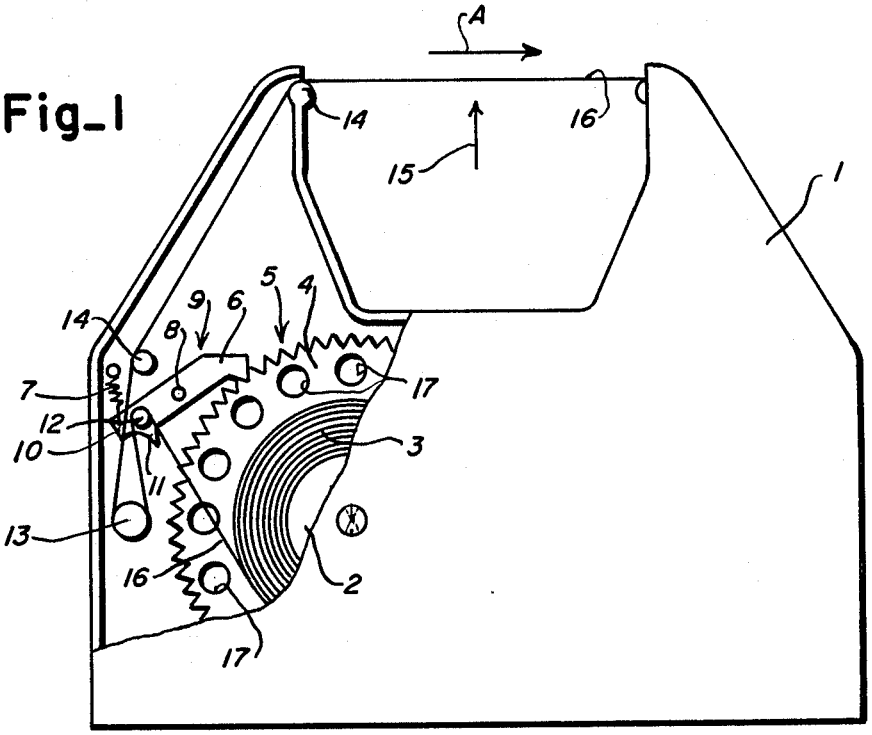
FIG. 1 is a plan view of a ribbon cassette with cover portions cut away.
Figure 3A:
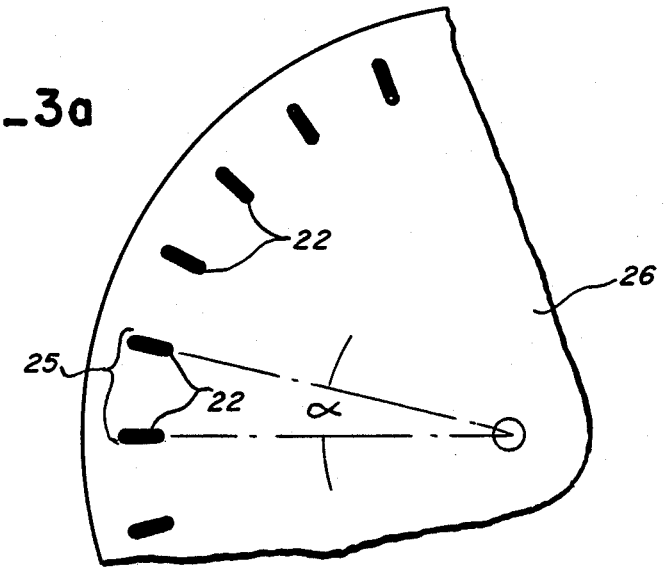
Figure 3B:
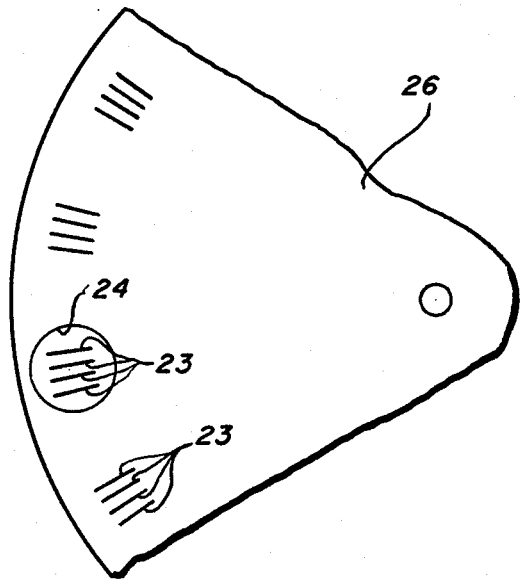

FIG. 3*a* is a partial view of a supply spool flange provided with markings of different character from that shown in the FIG. 1 embodiment of the invention; and FIG. 3*b* is a view similar to FIG. 3*a* of another embodiment of the invention.

Referring now to the drawing the ribbon cassette 1 is shown with the left-hand portion of the cover of the cassette broken away to show the most important elements of the ribbon cassette 1.

As shown in FIG. 1, there is wound on a ribbon supply spool core 2 a coil 3 of ribbon which is supported on a coil support or supporting flange 4, which is a rotational member connected to the spool core 2 for rotation therewith. The coil supporting flange 4 is provided with a circular array of circular holes 17 at equi spaced angular intervals located near its periphery and has teeth 5 at its peripheral edge. A tooth at one end of a first lever arm 6 of a two-armed lever 9 engages the teeth 5. The two-armed lever 9 which is subject to the action of spring 7, is pivotally mounted in the cassette housing 1 by means of a pin 8. Formed on the second lever arm 10 of the two-armed lever 9 is a pawl 11 which can be brought into engagement with the teeth 5 of the spool support or supporting flange 4 by pivoting the two-armed lever 9 against the action of the spring 7. A length 16 of ribbon leads from the ribbon coil 3 over a first ribbon guide roller 12, which is rotatably mounted on the second lever arm 10 of the two-armed lever 9, to a second ribbon guide roller 13 which is rotatably mounted in the cassette housing 1. From there, the ribbon 16, guided by further ribbon guide elements 14, reaches an impression region 15 situated outside the cassette housing 1 and finally leads back into the cassette housing 1 where it is wound on to a ribbon take-up spool (not illustrated) by means of a ribbon feed device (not illustrated), for example such as is known from German patent DE No. 25 53 329. Such ribbon feed devices are constructed so that they advance a constant amount of ribbon during each ribbon feed step.

The ribbon feed device (not illustrated) advances the ribbon 16 in the direction of the arrow A, when driven by a driving mechanism (not illustrated). Since the support 4 of the ribbon coil 3 is normally releaseably locked by engagement with the teeth 5 of the spool flange 4 by the first lever arm 6 of the two-armed lever 9 the tension in the ribbon 16 increases. This tension has the effect of deflecting the two-armed lever 9 against the force of the spring 7, so that the first lever arm 6 of the two-armed lever 9 releases the spool flange 4. Thus the ribbon 16 can move unhindered in the direction of the arrow A. When feed movement of the ribbon 16 stops, the tension in the ribbon 16 is released and the two-armed lever 9 again pivots back into its initial position so that the first lever arm 6 again locks the spool support 4. Thus, the ribbon 16 remains constantly tensioned and the spool support 4 cannot turn accidentally.

Now when the ribbon 16 is completely unwound from the ribbon supply spool core 2 and the ribbon feed device continues to advance ribbon, the two-armed lever 9 is deflected by the ever increasing tension in the ribbon 16, against the force of the spring 7, whereby the pawl 11 formed on the second lever arm 10 of the two-armed lever 9 engages the teeth 5 of the spool support 4 and thus locks the spool flange 4 against further rotation. The reason for this locking is explained fully below.

Figure 2:
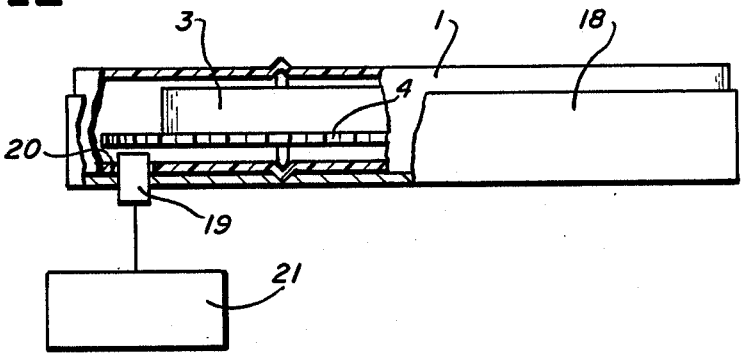
FIG. 2 is a rear view of the ribbon cassette of FIG. 1 showing the cassette mounted on a cassette holding or support device on a machine with parts cut away.

Referring now to FIG. 2, the ribbon cassette of FIG. 1, is shown mounted in a cassette receiving device or cassette holder 18 disposed on the machine. As revealed by broken away portions of the cassette holder and cassette 1 a sensor 19 is shown secured to the cassette holder 18 and projecting into the ribbon cassette 1 through an aperture 20 in the bottom of cassette housing 1. The sensor 19, which may be constructed in the form of, for example, a reflex light barrier, is disposed such that the passage of holes 17 (FIG. 1) in the spool support 4 can be detected by the sensor 19 when the spool support 4 rotates. The output state of the sensor 19 is monitored or scanned by means of a programmable control unit 21, such as are generally known, and which comprise at least one microprocessor with a ROM store containing the control program and a RAM store receiving the variable data.

Before describing how information gained by scanning the holes 17, enables identification of the type of ribbon in the mounted cassette 1, end of the ribbon, the supply of ribbon remaining on the ribbon supply spool and ribbon feed malfunctions, some general remarks first appear necessary.

As stated with reference to FIG. 1, the flange 4 supporting the wound ribbon supply coil 3 is provided with circular holes 17, which when scanned must enable information as to the type of ribbon to be determined and in addition, to enable detection of the end of the ribbon, the remaining supply of ribbon and ribbon feed malfunctions. This is possible in the FIG. 1 and FIG. 3 embodiments by an arrangment of sensible holes or marks 17, 22 wherein the holes 17 or marks 22 define between them a known angle$\alpha$ of rotation so that (1) the number of feed increments to move from one hole to another determines the type of ribbon, and (2) so that by comparing the number of ribbon feed increments carried out during rotation through the angle with stored or calculated values, determinations can be made as to the remaining supply of ribbon, and if the stored or calculated limiting value is exceeded, the end of ribbon or a ribbon feed malfunction signaled.

Thus the angle between two adjacent holes is determined or established according to the type of ribbon wound on the ribbon supply core 3 making it possible to determine the type of ribbon and associated feed increments by scanning the markings, and the angle or rotation defined by the markings themselves or alternatively or additionally the gap between (preferably adjacent) markings, enables determination of the remaining supply of ribbon by comparison of the number of ribbon feed steps carried out during rotation through this angle with stored or calculated values, and the end of ribbon or ribbon feed malfunctions to be detected when a stored or calculated limiting value is exceeded.

The mode of operation for recognition of the type of ribbon, end of the ribbon, of the supply of ribbon and of ribbon feed malfunctions will now be described in more detail.

RECOGNITION OF THE TYPE OF RIBBON

After each switching on of the machine or after a change of ribbon, which can be recognized, for example, by means of a so-called cover switch, the programmable control unit 21, by appropriate actuation of the drive for the ribbon feed mechanism, causes an advance of a certain length of ribbon, for example, that necessary for carbon C ribbons, during each drive step. At the same time, the programmable control unit 21 interrogates the sensor 19 cyclically. When a hole 17 passes the sensor 19, a signal appears at the sensor output. Upon the detection of the signal, the programmable control unit 21 starts a counter which is incremented by one with every ribbon feed drive pulse applied to drive the ribbon transport mechanism. When the next hole 17 passes the sensor 19, another signal appears at the sensor output. On detecting this later signal, the programmable control unit 21 compares the value of the counter contents with values stored under various addresses. When coincidence is found for a value within a preset range, the programmable control unit 21 initiates a control sequence through the address of this value, which control sequence determines the actuating signals for the drive of the ribbon feed mechanism so that a length of ribbon specific to the type of ribbon is advanced on each drive step. The type of ribbon mounted in the machine may also be indicated by appropriate actuation of a display device.

When the type of ribbon is identified by the method described above, it must be borne in mind, with regard to determining the angle of rotation between two adjacent holes 17, that the length of ribbon advanced during rotation through that angle depends on the coil diameter of the wound ribbon. This means that a large diameter coil produces a different counter content between two successive sensor signals from that produced when the coil diameter is small. From this it follows that the angles of rotation for the identification of the different types of ribbon have to be selected so that the particular counter content permits unambiguous identification. Therefore, in selecting the angles of rotation, conditions such as the following must be satisfied:

$Z_{min\ I}$ is greater than $Z_{max\ II}$ $Z_{min\ II}$ is greater than $Z_{max\ III}$ $Z_{min\ III}$ is greater than $Z_{max\ IV}$, and so on;

where:

$Z_{min\ I}$ denotes the minimum counter content for ribbon type 1

$Z_{min\ II}$ denotes the minimum counter content for ribbon type 2

$Z_{min\ III}$ denotes the minimum counter content for ribbon type 3

$Z_{max\ II}$ denotes the maximum counter content for ribbon type 2

$Z_{max\ III}$ denotes the maximum counter content for ribbon type 3

$Z_{max\ IV}$ denotes the maximum counter content for ribbon type 4

RECOGNITION OF REMAINING RIBBON SUPPLY

During the operation of the machine, the programmable control unit 21 advances a certain length of ribbon which is specific to the type of ribbon by appropriate actuation of the drive for the ribbon feed mechanism, and at the same time cyclically interrogates the sensor 19. When a hole 17 passes the sensor 19, a signal appears at the output of the sensor 19. When the programmable control unit 21 detects this signal, it starts a counter which is incremented by one on each actuating step of the drive for the ribbon feed mechanism. When the next hole 17 passes the sensor 19, a signal again appears at the sensor output. This signal causes a comparison of the counter contents with values stored under various addresses to be carried out by the programmable control unit 21. The addresses of the values which are used for this comparison depend on the type of ribbon used, which is determined automatically by the programmable control unit 21 during previous recognition of the type of ribbon, or is defined by an appropriate manual setting. When the programmable control unit 21 finds coincidence between the counter contents and a stored value within a preset range during this comparison, it initializes a control sequence which causes information corresponding to the remaining supply of ribbon to be displayed or updates a corresponding display as the case may be. After each comparison the programmable control unit 21 resets the counter and starts it afresh.

The above cycle is be carried out after each time the machine is switched on or after each change of ribbon without printing and is be constantly repeated during a printing operation so that information about the remaining supply of ribbon is present at every moment.

Recognition of the end of the ribbon or of ribbon feed malfunctions

Recognition of the end of the ribbon or of ribbon feed malfunctions is effected substantially in the same manner as recognition of remaining ribbon supply and so only the differences in the procedure will now be described.

When the end of the ribbon is reached or if the ribbon breaks, rotation of the ribbon supply spool ceases completely during a ribbon transport step; while if the ribbon is jammed, rotation is at least greatly inhibited. These circumstances can be utilized, within the scope of the method of recognizing or identifying the remaining ribbon supply, in the sense that the counter started by an output signal from the sensor 19 is interrogated cyclically by means of the programmable control unit 21 for a maximum count which can be preset. When the counter reaches the maximum count, the programmable control unit 21 stops the further printout of characters and delivers a corresponding signal to the operator or to a connected computer as the case may be.

When the end of the ribbon is reached or rotation of the ribbon supply spool inhibited, the ribbon supporting flange 4 can be locked by means of the two-armed lever 9, as a result of the increased in tension in the ribbon 16, as already described above. Without this measure, when the end of the ribbon is reached or the ribbon supply spool jammed, the ribbon supporting flange 4 would execute oscillating movements. Thus if the sensor 19 was at the edge of a hole 17, it would deliver unwanted signals, and the end of the ribbon or jamming of the ribbon supply spool could not be detected. Locking the spool support 4 reliably prevents this.

It must be noted that the methods indicated above for the recognition or identification of the type of ribbon, the remaining ribbon supply, end of ribbon or ribbon feed malfunctions, are by way of example only. This applies in particular to the recognition of the type of ribbon. The actual method of recognizing the type of ribbon need not be tied to the angle of rotation between adjacent holes 17, or between marks 22 disposed over a circular path on part of rotational member 26 as illustrated in FIGS. 1 and 3*a*. As with FIG. 1 the arrangement in FIG. 3 is such that each two adjacent marks 22 form a certain angle$\alpha$ of rotation which is selected so that the type of ribbon can be determined from the angle of rotation, more particularly from the number of ribbon feed cycles necessary to rotate the ribbon supply spool through this angle of rotation. In this case, the angle of rotation represents the marking for the recognition of the type of ribbon.

The part of the rotational member 26 illustrated in FIG. 3*b*, which again, as with member 26 in FIG. 3*a*, may be the supporting flange 4 in FIG. 1, is provided with sensible marks 23 which are disposed over a circular path. The marks 23 are, however, combined to form code groups 24. The code groups 24 indicate the type of ribbon in the form of a code and can be recognized directly by the programmable control unit 21 from the output of the sensor 19. In this case, the code groups 24 form the marking for identifying ribbon type, and angles between code groups, as explained with reference to FIG. 1, enable determination and detection of remaining ribbon supply, end of ribbon and ribbon malfunctions.

Modifications or combinations of the possible formations of the markings shown in FIGS. 3*a* and 3*b* are familiar to persons skilled in the art and therefore do not need any further explanation.

It should also be noted that marks, other than marks such as 17, 22, 23, which can be scanned optically are conceivable, and that scanning may be based on other physical principles, for example, mechanical or inductive scanning, etc. The fact that the scanning principle has an effect on the form of the markings is obvious. It should also be mentioned that the marks can obviously also be disposed over a plurality of circular paths. In this case a corresponding number of sensors must be provided for the scanning.

The invention claimed is:

1. In combination with a typewriter having a programmed control unit for generating signals to effect incremental feed of a ribbon and a support for mounting a ribbon cassette;

a sensor mounted on said support;

said ribbon cassette having a rotatably mounted ribbon supply spool supported in a cassette housing between top and bottom walls of said cassette housing;

said ribbon on said supply spool being adapted to be incrementably drawn off for passage past a printing point in response to feed signals from said control unit;

a marking element co-rotating with said supply spool having a plurality of coded markings disposed over a circular path around the rotation of said supply spool and grouped together into code groups and adapted to be sensed in turn by said sensor incident to rotation of said marking element as ribbon is drawn off said supply spool;

said coded markings being angularly spaced from one another by a predetermined angle;

said sensor located for scanning said coded markings and spacing between said coded markings;

said programmed control unit connected to said sensor to determine from said scanning, the type of said ribbon, the end of said ribbon, the amount of said ribbon remaining on said ribbon supply spool, and ribbon feed malfunctions.

2. In the combination with a typewriter as in claim 1, said marking element including a flange on said supply spool.

3. In the combination with a typewriter as in claim 2, said flange having teeth on its peripheral edge;

a two-armed lever having a first lever arm and a second lever arm pivotally mounted in said cassette housing;

said first lever arm being adapted to engage said teeth of said flange, and thus lock said spool against rotation when said lever is in a first end condition;

said second lever arm being adapted to engage said teeth of said flange, and thus lock said spool against rotation when said lever is in a second end condition;

a spring urging said two-armed lever towards its first end condition;

a ribbon guide element disposed on said second lever arm of said two-armed lever such that tension in said ribbon urges said two-armed lever to pivot about a pivot pin towards its second end condition, against the force of said spring.

4. In the combination with a typewriter as in claim 1, means for locking said marking element and said spool from rotating when the end of said ribbon is reached.

5. In the combination with a typewriter as in claim 1, at least one aperture located in said cassette housing for enabling said coded markings and said spacing between said markings to be sensed in turn by said sensor.

6. In combination with a typewriter having a programmed control unit for generating to effect incremental feed of a ribbon and a support for mounting a ribbon cassette;

a sensor mounted on said support;

said ribbon cassette having a rotatably mounted ribbon supply spool supported in a cassette housing between top and bottom walls of said cassette housing;

said ribbon on said supply spool being adapted to be incrementably drawn off for passage past a printing point in response to feed signals from said control unit;

a marking element co-rotating with said supply spool having a plurality of markings disposed over a circular path around the rotation axis of said supply spool and adapted to be sensed in turn by said sensor incident to rotation of said marking element as ribbon is drawn off said supply spool;

said marking element including a flange on said supply spool;

said markings being angularly spaced from one another by a predetermined angle;

said flange having teeth on its peripheral edge;

a two-armed lever having a first lever arm and a second lever arm pivotally mounted in said cassette housing;

said first lever arm being adapted to engage said teeth of said flange, and thus lock said spool against rotation when said lever is in a first end condition;

said second lever arm being adapted to engage said teeth of said flange, and thus lock said spool against rotation when said lever is in a second end condition;

a spring urging said two-armed lever towards its first end condition;

a ribbon guide element disposed on said second lever arm of said two-armed lever such that tension in said ribbon urges said two-armed lever to pivot about a pivot pin towards its second end condition, against the force of said spring;

said sensor located for scanning said markings and spacing between said markings;

said programmed control unit connected to said sensor to determined from said scanning, the type of said ribbon, the end of said ribbon, the amount of said ribbon remaining on said ribbon supply spool, and ribbon feed malfunctions.

7. In the combination with a typewriter as in claim 6, said markings forming at least one ring comprising a plurality of holes in equally spaced relationship around said marking element.

* * * * *